4/17/86 OR 4,593,859

United States Patent [19]

Nakaoji et al.

[11] Patent Number: 4,593,859

[45] Date of Patent: Jun. 10, 1986

[54] PREPARATION OF DEASHED HIGH SOLID CONCENTRATION COAL-WATER SLURRY

[75] Inventors: Kazuhiko Nakaoji, Ichihara; Mitsugu Kamao, Chigasaki; Kunizo Shinano, Matsudo; Takashi Kuwabara; Masazumi Ito, both of Kawasaki; Kaoru Aoki, Hiratsuka; Hayami Ito, Himeji; Shuhei Tatsumi; Shoichi Takao, both of Akashi; Nitaro Suzuki; Takashi Watanabe, both of Funabashi, all of Japan

[73] Assignees: Electric Power Development Co., Ltd., Tokyo; Kawasaki Jukogyo Kabushiki Kaisha, Kobe; Sumitomo Heavy Industries, Ltd., Tokyo, all of Japan

[21] Appl. No.: 611,069

[22] Filed: May 17, 1984

[30] Foreign Application Priority Data

May 21, 1983 [JP] Japan ..... 58-89699

[51] Int. Cl.[4] ..... B02C 19/12

[52] U.S. Cl. ..... 241/20; 44/51; 241/21; 241/24; 241/29

[58] Field of Search ..... 241/81, 21, 24, 20, 241/29; 44/51

[56] References Cited

U.S. PATENT DOCUMENTS 4,132,365 1/1979 Verschoor ..... 241/24 X

*Primary Examiner*—Mark Rosenbaum

*Attorney, Agent, or Firm*—Flynn, Thiel, Boutell & Tanis

[57] ABSTRACT

This process, which comprises subjecting coal to gravity classification to classify into a low ash coal, a middle ash coal and a high ash coal; deashing the middle ash coal by flotation; and using the deashed middle ash coal together with the low ash coal as the materials for producing a coal-water slurry, provides a low ash content and high solid content coal-water slurry in a high coal recovery as well as economically. This coal-water slurry is able to handle, store and burn as are fuel oils.

4 Claims, 1 Drawing Figure

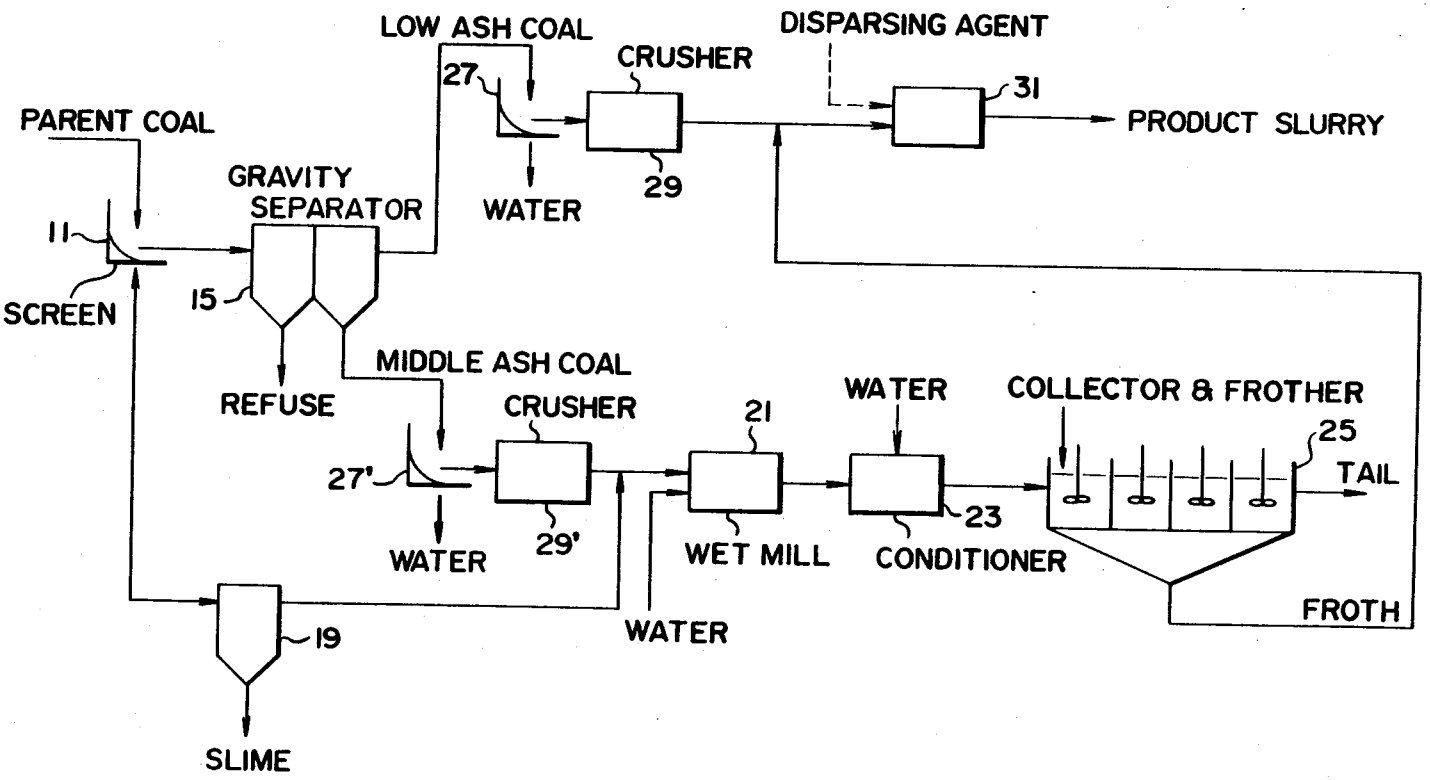
PARENT COAL
11
SCREEN
GRAVITY SEPARATOR
15
LOW ASH COAL
27
WATER
CRUSHER
29
DISPARSING AGENT
31
PRODUCT SLURRY
MIDDLE ASH COAL
REFUSE
27'
WATER
CRUSHER
29'
WET MILL
21
WATER
WATER
CONDITIONER
23
COLLECTOR & FROTHER
25
TAIL
FROTH
19
SLIME

PREPARATION OF DEASHED HIGH SOLID CONCENTRATION COAL-WATER SLURRY

BACKGROUND OF THE INVENTION

The present invention relates to a process for preparing a coal-water slurry which is nearly the same, to handle, store and burn, as fuel oils, in particular a process for the preparation of a coal-water slurry having low ash content and high solid content with a high coal recovery as well as economically, regardless of the amount of ash content of parent coal.

It is well known to prepare a high solid content coal-water slurry by mixing a ground coal with water or wet grinding a mixture of crushed coal and water. In these preparations it is desirable to reduce the amount of ash which is mingled in the slurry accompanied by the coal as much as possible. The coal contains more or less of ash comprising $Al_2O_3$, $SiO_2$, FeS and the like. Mingling of ash in the coal-water slurry is disadvantageous in that when said slurry is burnt, not only is abrasion of the boiler walls brought about, but also the heating value of said slurry is lowered.

Under these circumstances, in the preparation of a high concentration coal-water slurry there has hitherto been employed a process which comprises subjecting a relatively coarse grain-sized parent coal to gravity classification to thereby obtain a low ash coal whose ash amount is in the allowable range, and grinding said low ash coal alone to obtain a coal-water slurry, or a process which comprises grinding the whole amount of a parent coal itself and thereafter subjecting it to deash treatment for obtaining a low ash coal. However, the former process is defective in that a certain amount of combustible matter is not transferred to said low ash coal and is not utilized as the combustible component for slurry, and therefore the coal recovery is low. On the other hand, the latter process is high in coal recovery as compared with the former process, but is economically unprofitable in that because a large amount of coal is subjected to deash treatment, there must be used a large-sized deash equipment and accordingly the costs of equipment and working the apparatus are high.

SUMMARY OF THE INVENTION

The object of the present invention is to provide a process which is capable of eliminating the above mentioned problems and producing a deashed high concentration slurry with a high coal recovery as well as in an economical manner even when coal having a relatively large ash content is used as the parent coal.

In order to achieve the above mentioned object, the present invention provides a process for preparing a deashed high solid concentration coal-water slurry comprising the steps of (a) subjecting coal having a particle size of under 100 mm under coal to gravity classification to classify said coal into a low ash coal having a specific gravity of 1.4 or less, a high ash coal having a specific gravity of 1.5 or more and a middle ash coal having a specific gravity higher than that of the low ash coal and lower than that of the high ash coal; (b) grinding said middle ash coal so that 50% or more thereof has a particle size of under 200 mesh and adding water thereto for preparing a middle coal slurry having a solid concentration of 5–25%; (c) subjecting this middle coal slurry to flotation for obtaining a froth having a reducing ash content; and (d) mixing the low ash coal obtained in the preceding step (a) with said froth, and therafter grinding said coal mixture so that 50% or more thereof has a particle size under 200 mesh or grinding said low ash coal, prior to mixing it with the froth, so that 50% or more thereof has a particle size under 200 mesh and thereafter mixing this with said froth.

BRIEF DESCRIPTION OF THE DRAWING

The drawing is a flow diagram illustrating one embodiment of the present invention.

DETAILED DESCRIPTION OF THE INVENTION

Generally speaking, the specific gravity of coal depends upon the amount of ash contained therein. Accordingly, it is possible to classify the coal optionally in respect of ash content by subjecting relatively coarse particle-sized coal to gravity classification. The first step of the present invention classifies, using the gravity classification, coal having a particle size under 100 mm into 3 fractions, namely the low ash coal whose specific gravity is 1.4 or less, the high ash coal whose specific gravity is 1.5 or more and the middle ash coal whose specific gravity is higher than the low ash coal and lower than the high ash coal. In this connection, attention should be given to the fact that the upper limit of the specific gravity value of the coal classified as the low ash coal in the present invention and the lower limit of the specific gravity value of the coal classified as the high ash coal in the present invention may be established optionally in the range of 1.4 or less and in the range of 1.5 or more, respectively, according to the target ash amounts of the final product coal-water slurry, and the upper limit specific gravity value of the coal classified as the middle ash coal is altered by said established value. For instance, in case the coal having a specific gravity of 1.35 or less is classified as a low ash coal and the coal having a specific gravity of 1.6 or more as a high ash coal according to gravity classification, the coal having a specific gravity of 1.35–1.6 is classified as a middle ash coal from the parent coal.

The middle ash coal classified from the parent coal is dewatered and crushed to a particle size of under 3 mm, and mixed with under-size particles of the screen installed prior to the gravity separator. The mixture is wet ground so that 50% or more thereof, preferably 70% or more thereof, may have a particle size of under 200 mesh. The wet grinding can be effected in the presence of a dispersing agent or in the absence of said agent. When using the dispersing agent, its amount is in the range of 0.01–3%, preferably in the range of 0.1–1% based on the coal weight. The wet ground middle ash coal is then added with water, whereby there is prepared a middle ash coal slurry having a solid concentration suitable for the flotation effected in the next step, that is 5–25%, preferably 5–15%.

Flotation of the middle ash coal is effected in the presence of a collector whose amount is 0.05–0.35, preferably 0.1–0.3% based on the coal weight and in the presence of a frother whose amount is 0.02–0.2%, preferably 0.03–0.15%, and thus there is obtained a deashed coal slurry containing the ash in an amount less than the ash contained in the middle ash coal slurry before flotation, namely, froth. The collectors usable in the flotation step include diesel fuel oil, kerosine and the like, and the frothers usable in the present invention include methyl isobutyl carbinol (MIBC), pine oil and the like.

The froth obtained by the flotation step can be dewatered as occasion demands.

The coal classified as a low ash coal from the parent coal in the gravity classification step is crushed, thereafter mixed with said froth or dewatered froth and then said mixture is wet ground typically so that 50% or more of the mixed low ash coal, preferably 70% or more thereof, may become of a particle size under 200 mesh. The low ash coal is previously subjected to dry or wet grinding prior to its mixing with the froth, and the thus ground low ash coal may be mixed with the froth or dewatered froth obtained from the flotation step.

Regardless of whether the low ash coal is subjected to wet or dry grinding, and regardless of whether said grinding is effected before or after it is mixed with the froth, the ground low ash coal is mixed with the froth to thereby prepare a final product of the present invention, namely a coal-water slurry. Generally speaking, the product slurry desirably contains a dispersing agent in the range of 0.01–4%, preferably 0.1–2% based on the coal weight, for the purpose of enhancing the stability of the product slurry. The dispersing agents used in the present invention include anionic, cationic and nonionic surface active agents, and they may be used singly or in combinations which is selected properly according to the kind of coal used. Citing concrete examples of each surface active agent, the anionic surface active agents includes salts of sulfuric acid esters of fatty oils, salts of sulfuric acid esters of higher alcohols, salts of sulfuric acid esters of ethers, salts of sulfuric esters of olefins, alkyl allyl sulfonic acid salts, sulfonic acid esters of dibasic acid ester, salts of dialkyl sulfo succinic acid, acylsarcosinate, salts of alkyl benzene sulfonic acid, salts of alkyl sulfonic acid esters, salts of dialkylsulfo succinic acid esters, alkyl acid or/and maleic anhydride copolymer, polycyclic aromatic sulfonate, formalin compound and the like. As cationic surface active agents, there can be enumerated alkyl amine salts, quaternary amine salts and the like. The nonionic surface active agents used herein include polyoxy alkyl ethers, polyoxy ethylene alkyl phenol ethers, oxyethylene-oxypropyrene block polymers, polyoxyethylene alkyl amines, sorbitan fatty acid esters, polyoxy ethylene sorbitan fatty acid esters and the like.

The drawing is a flow diagram illustrating one embodiment of the process according to the present invention. In the drawing, parent coal having a particle size under 100 mm is subjected to screening by means of a screen 11 of 0.1–20 mm, preferably 0.5–2 mm mesh, and thereafter oversize particles are supplied into a gravity separator 15 wherein the supplied parent coal is classified a low ash coal having a specific gravity of 1.4 or less, a high ash coal having a specific gravity of 1.5 or more, and a middle ash coal whose specific gravity is higher than the low ash coal and lower than the high ash coal. The high ash coal is rejected as refuse from the separator 15. Concerning the under-size particles of the screen 11, it is preferable to recover the coal by separating the slime contained therein by using a separator 19, and treat it in admixture with the middle coal obtained from the gravity separator 15 after the middle coal has been subjected to treatment in the dewaterer 27' and crusher 29'.

The admixture is supplied in a wet mill 21 together with water in an amount sufficient to obtain a coal-water mixture having a solid concentration 5–60%, preferably 10–50%, and in this mill, and the same is ground so that 50% or more, preferably 70% or more of the coal may become less than 200 mesh, whereby there is prepared a slurry. The slurry obtained from the wet mill 21 is then sent to a conditioner 23 and is added with water, whereby the solid concentration of said slurry is controlled in the range of 5–25%, preferably 5–15% which is suitable for flotation. The slurry supplied from the conditioner 23 to a flotation machine 25 is subjected to flotation in the presence of a collector whose amount of 0.05–0.35%, preferably 0.1–0.3% based on the coal weight and in the presence of a frother whose amount is 0.02–0.2%, preferably 0.03–0.15% based on the coal weight, and then a froth having a deashed coal concentration of 15–30%, preferably 18–25% is recovered from the flotation machine.

The coal classified as a low ash coal by means of the gravity separator 15 is dewatered by a screen 27, thereafter is supplied in a crusher 29 so as to crush generally to a particle size of under 30 mm, preferably under 5 mm, and then is mixed with the froth coming from the flotation machine. This mixture is then supplied in a wet mill 31 and is ground so that 50% or more, preferably 70% or more of the low ash coal may become 200 mm under in the presence of a dispersing agent whose amount may typically be 0.01–4%, preferably 0.1–2% based on the coal weight. By this grinding, there is prepared a final product, namely a deashed high solid concentration coal-water slurry. In the coal-water slurry prepared according to the process of the present invention, typically, the solid concentration is at least 60%, and at least 50%, preferably 70% of the coal contained in the slurry has a particle size of 200 mesh under. However, the solid concentration of the slurry can be changed optionally in the usual manner well known to those skilled in this art of controlling the amount of water used in the process or adding an optional dewatering step. Likewise, the particle size of the coal in the slurry may be changed optionally by controlling the grinding degree of the coal.

EXAMPLE 1

By using parent coal having a particle size of 20 mm or less and an ash content of 8.2%, there was prepared a deashed high concentration slurry according to substantially the flow shown in the drawing, but without using a slime separator 19.

1570 g of the parent coal (A) was screened by means of a 0.5 mm-mesh screen to obtain 94 g (6.0 wt. %) of undersize particles whose ash content is 15.0% and 1476 g (94.0 wt. %) of oversize particles whose ash content is 7.8%.

These oversize particles was subjected to the gravity classification. The particles whose specific gravity is 1.6 or more and ash content is 57.7% or more were separated as refuse, and the remainder was separated into 1243 g (79.2 wt. %) low ash coal having a specific gravity of 1.4 or less and an ash content is 4.6%, and 157 g (10.0 wt. %) middle ash coal having a specific gravity of 1.4–1.6 and an ash content of 9.0%.

Said middle ash coal was mixed with said undersize particles to obtain 251 g (16 wt. %) of mixture having an ash content of 11.3%. Water was added to this mixture to regulate the solid concentration to be 50%, and thereafter was ground in a wet mill so that 75% of the coal may become a particle size of 200 mesh (74 μm) under. Water was added again to this ground matter to regulate the solid concentration to be 15 wt. %, thereafter a collector (fuel oil) in an amount of 0.1% per coal and a froth (MIBC) in an amount of 0.1 wt. % per coal were added to same for flotation in order to remove 31 g (2.0 wt. %) of tail whose ash content is 50 wt. %; and thus 220 g (14.0 wt. %) of a flotation froth having an ash content of 5.8% was recovered. The solid concentration of said froth was 26 wt. %.

On the other hand, said low ash coal was subjected to crushing so that 90% thereof may become 3 mm under. This crushed low ash coal was mixed with said flotation froth, further a dispersing agent was added thereto in an amount of 0.8 wt. % based on the coal weight, and was subjected to wet grinding so as to obtain a high concentration slurry having a solid concentration of 70 wt %. This high concentration slurry was observed to have an ash content of 4.8% and to have yield of 93.2% and coal recovery of 96.6%.

EXAMPLE 2

This example prepared a deashed high concentration slurry in accordance with the flow stated in Example 1 except that a dewatered step was provided on the downstream side of a flotation step.

800 g of the parent coal (A) having a particle size of 10 mm or less and an ash content of 8.2% was screened by means of a 0.5 mm-mesh screen to obtain 101 g (12.6 wt. %) of undersize particles having an ash content of 10.0% and 699 g (87.4 wt. %) of oversize particles having an ash content of 7.9%. These oversize particles was subjected to the gravity classification, and 52 g (6.5 wt. %) of oversize particles having a specific gravity of 1.6 or more and an ash content of 52.2% was separated as refuse. Thereafter, the remainder was further separated into a 487 g (60.9 wt. %) of low ash coal having a specific gravity of 1.4 or less and an ash content of 3.1% and 160 g (20.0 wt. %) of middle coal having a specific gravity of 1.4–1.6 and an ash content of 8.8%.

After dewatering and crushing, this middle ash coal was mixed with the undersize particles to obtain 261 g (32.6 wt. %) of a mixture having an ash content 9.3 %. Water was added to this mixture so that the solid concentration may become 45%, and thereafter was subjected to grinding in a wet mill so that 75% of the coal may have a particle size of 200 mesh (74 μm) under. Water was added again to this ground matter to regulate the solid concentration to be 10 wt. %, thereafter a collector (fuel oil) in an amount of 0.1 wt. % per coal and a frother in an amount of 0.04 wt. % per coal were added to same for flotation to remove 17 g (2.1 wt. %) of tail having an ash content of 37.4 wt. %, thereby recovering 244 g (30.5 wt. %) of a flotation froth having an ash content of 7.3%. The solid concentration of this flotation froth was 22 wt. %, and concentrated by means of a dehydrater.

On the other hand, said low ash coal was subjected to crushing so that 90% thereof may become 3 mm under. This crushed low ash coal was mixed with said dewatered flotation froth, further a dispersing agent was added thereto in an amount of 0.7 wt. % per coal, and was subjected to wet grinding. Thus, a high concentration slurry having a solid concentration of 72 wt. %. This high concentration slurry was observed to have an ash content of 4.5% and further to have yield of 91.4% and the coal recovery of 95.1%.

EXAMPLE 3

In this example, there is shown the procedure of dry grinding a coal classified as a low ash coal prior to mixing with a froth coming from a flotation step.

A parent coal (B) having a particle size of 60 mm or less and an ash content of 24.6% (1100 g) was screened by means of a 0.5 mm-mesh screen to obtain 88 g (8.0 wt. %) of undersize particles having an ash content of 19.0% and 1012 g (92.0 wt. %) of oversize particles having an ash content of 25.1%.

These oversize particles were subjected to the gravity classification to separate 125 g (11.4 wt. %) of oversize particles, whose ash content is 75.0%, as refuse. Thereafter, the remainder was separated into 724 g (65.8 wt. %) of low ash coal having an ash content of 17.5% and 163 g (14.8 wt. %) of middle ash coal having an ash content of 22%.

After dewatering and crushing, this middle ash coal was mixed with the undersize particles to thereby obtain 251 g (22.8 wt. %) of a mixture having an ash content of 21.0%, Water was added to this mixture for adjusting the solid concentration to be 50%, and thereafter was ground in a wet mill so that 80% of the coal may become 200 mesh (74 μm) under. Water was added again to this ground matter to regulate the solid content to be 15 wt. %, and a collector (residual oil) in an amount of 0.2 wt. % per coal and a frother (MIBC) in an amount of 0.05 wt. % per coal were added thereto for the practice of flotation, whereby 16 g (1.5 wt. %) of tail having an ash content of 75 wt. % was removed and 235 g (21.4 wt. %) of a flotation froth having an ash content of 17.3% was recovered.

On the other hand, 724 g of the above mentioned low ash coal was crushed so that 90% thereof may have a particle size of 3 mm under. In succession, the same was subjected to a grinder so that 80% of the coal may have a particle size of 200 mesh under. This ground low ash coal and the aforesaid flotation froth were mixed by means of a mixer, and simultaneously a dispersing agent was added thereto in a amount of 0.8% per coal to thereby obtain a high concentration slurry having a solid concentration of 67%. This high concentration slurry was observed to have an ash content of 17.5%, a yield of 87.1%, and a coal recovery of 95.4%.

EXAMPLE 4

In this example, there is shown the procedure of dry grinding a coal classified as a low ash coal prior to mixing with a dewatered froth coming from a flotation step.

530 g of a parent coal (B) having a particle size of 35 mm or less and an ash content of 24.6% was screened by means of a 0.5 mm-mesh screen to obtain 75 g (14.2 wt. %) of undersize particles having an ash content of 17.8% and 455 g (85.8 wt. %) of oversize particles having an ash content of 25.7%.

These oversize particles were subjected to the gravity classification to separate 80 g (15.1 wt. %) of oversize particles having an ash content of 86.1%, as refuse, thereafter the remainder was separated into 202 g (38.1 wt. %) of low ash content having an ash content of 7.3% and 173 g (32.6 wt. %) of middle ash coal having an ash content of 19.6%.

After dewatering and crushing, this middle ash coal was mixed with the aforesaid undersize particles to thereby obtain 248 g (46.8 wt. %) of a mixture having an ash content of 19.1%. Water was added to this mixture in order to adjust the solid concentration to be 50%, and thereafter was ground in a wet mill so that 80% of the coal may become 200 mesh (74 μm) under. Water was added again to this ground matter to regulate the solid concentration to be 10 wt. %, and thereafter a collector (residual oil) in an amount of 0.2 wt. % per coal and a frother (MIBC) in an amount of 0.05 wt. % per coal were added thereto for the practice of flotation, whereby 15 g (2.8 wt. %) of tail having an ash content of 57 wt. % was removed and 233 g (44.0 wt. %) of a flotation froth having an ash content of 16.6% was recovered and dewatered.

On the other hand, 202 g of the aforesaid low ash coal was subjected to crushing so that 85% of the coal may have a particle size of 3 mm under. In succession, the same was subjected to grinding by means of a grinder so that 75% of the coal may have a particle size of under 200 mm. This ground low ash coal and the dewatered flotation froth were mixed by means of a mixer, and simultaneously a dispersing agent was added thereto in an amount of 0.6% per coal to thereby obtain a high solid concentration of 71%. This high concentration slurry was observed to have an ash content of 12.3%, a yield of 82.1% and a coal recovery of 99.5%.

According to the process of the present invention, the parent coal can be classified into low ash coals, middle ash coals and high ash coals (refuse) and the middle coals alone are deashed by flotation, so that the load in the flotation step can be reduced, in addition as the deashed middle ash coals can be utilized, together with low ash coals, as the materials for preparing a coal-water slurry, the coal recovery can be improved. It is safe to say that the process according to the present invention is exceedingly useful as a process for preparing a coal-water slurry replaceable for fuel oil.

We claim:

1. A process for preparing a deashed, coal-water slurry containing at least 60 wt. % of coal solids, at least 50 wt. % of said coal solids having a particle size of less than 200 mesh, which comprises the steps of:

(a) subjecting coal particles having a particle size of less than 100 mm to gravity classification and separation, and separately recovering three fractions as follows:
  (i) particles of low ash coal having a specific gravity of 1.4 or less,
  (ii) particles of high ash coal having a specific gravity of 1.5 or higher, and
  (iii) particles of middle ash coal having a specific gravity of higher than that of said low ash coal and lower than that of said high ash coal;

(b) grinding said middle ash coal fraction (iii) so that 50 wt. % or more of said middle ash coal fraction has a particle size of less than 200 mesh and adding water thereto to obtain a middle ash coal-water slurry containing from 5 to 25 wt. % of middle ash coal particles;

(c) subjecting said middle ash coal-water slurry obtained in step (b) to flotation and separately obtaining
  (iv) a froth of coal particles having a reduced ash content, and
  (v) tailings having an increased ash content; and (d) mixing the froth (iv) obtained in step (c) with the low ash coal fraction (i) obtained in step (a) to obtain a mixture containing at least 60 wt. % of coal particles, and subjecting the mixture to wet grinding so that 50 wt. % or more of the coal contained in the mixture has a particle size of less than 200 mesh, whereby to obtain said deashed, coal-water slurry.

2. A process according to claim 1, wherein the middle ash coal is subjected to wet grinding in the step (b).

3. A process according to claim 1, wherein the low ash coal is subjected to dry grinding prior to mixing with the froth in the step (d).

4. A process for preparing a deashed, coal-water slurry containing at least 60 wt. % of coal solids, at least 70 wt. % of said coal solid having a particle size of less than 200 mesh, which comprises the steps of:

(a) subjecting coal particles having a particle size of less than 100 mm to gravity classification and separation, and separately recovering three fractions as follows:
  (i) particles of low ash coal having a specific gravity of 1.4 or less,
  (ii) particles of high ash coal having a specific gravity of 1.5 or higher, and
  (iii) particles of middle ash coal having a specific gravity of higher than that of said low ash coal and lower than that of said high ash coal;

(b) discarding said high ash coal fraction (ii), (c) grinding said middle ash coal fraction (iii) so that 70 wt. % or more of said middle ash coal fraction has a particle size of less than 200 mesh and adding water thereto to obtain a middle ash coal-water slurry containing from 5 to 15 wt. % of middle ash coal particles;

(d) subjecting said middle ash coal-water slurry obtained in step (c) to flotation and separately obtaining
  (iv) a froth containing from 18 to 25 wt. % coal particles having a reduced ash content, and
  (v) tailings having an increased ash content; and (e) discarding said tailings;

(f) crushing said low ash coal fraction (i) to a particle size of less than 5 mm; and (g) mixing the froth (iv) obtained in step (c) with the crush low ash coal fraction (i) obtained in step (f) and with a dispersing agent to obtain a mixture containing at least 60 wt. % of coal particles, and subjecting the mixture to wet grinding so that 70 wt. % or more of the coal contained in the mixture has a particle size of less than 200 mesh, whereby to obtain said deashed, coal-water slurry.

* * * * *

UNITED STATES PATENT AND TRADEMARK OFFICE

CERTIFICATE OF CORRECTION

PATENT NO. : 4 593 859

DATED : June 10, 1986

INVENTOR(S) : Kazuhiko Nakaoji et al

It is certified that error appears in the above-identified patent and that said Letters Patent is hereby corrected as shown below:

Column 1, line 56; delete "under coal".

Column 4, line 22; change "200mm" to ---200mesh---.

line 53; after "57.7%" delete "or more".

line 68; change "froth" to ---frother---.

Column 6, line 57; after "low ash" change "content" to ---coal---.

Column 7, line 13; change "200mm" to ---200mesh---.

Signed and Sealed this

Fourteenth Day of April, 1987

*Attest:*

*Attesting Officer*

DONALD J. QUIGG

*Commissioner of Patents and Trademarks*